US006290494B1

(12) United States Patent
Barkdoll

(10) Patent No.: US 6,290,494 B1
(45) Date of Patent: Sep. 18, 2001

(54) METHOD AND APPARATUS FOR COAL COKING

(75) Inventor: Michael P. Barkdoll, Knoxville, TN (US)

(73) Assignee: Sun Coke Company, Knoxville, TN (US)

( * ) Notice: Subject to any disclaimer, the term of this patent is extended or adjusted under 35 U.S.C. 154(b) by 0 days.

(21) Appl. No.: 09/680,187

(22) Filed: Oct. 5, 2000

(51) Int. Cl.[7] ..... F27D 3/06

(52) U.S. Cl. ..... 432/121; 432/239; 202/248; 202/262

(58) Field of Search ..... 432/5, 13, 121, 432/152, 153, 186, 239; 202/248, 262; 110/101 R; 366/150.1

(56) References Cited

U.S. PATENT DOCUMENTS

| | | | | |
|---|---|---|---|---|
| 3,897,312 | * | 7/1975 | Armour et al. | 202/262 |
| 3,912,091 | * | 10/1975 | Thompson | 414/196 |
| 4,040,910 | | 8/1977 | Knappstein et al. . | |
| 4,067,462 | | 1/1978 | Thompson . | |
| 4,314,787 | * | 2/1982 | Kwasnik et al. | 202/262 |
| 4,375,388 | | 3/1983 | Hara et al. . | |
| 4,527,488 | * | 7/1985 | Lindgren | 105/247 |
| 6,059,932 | | 5/2000 | Sturgulewski . | |
| 6,152,668 | * | 11/2000 | Knoch | 202/262 |

FOREIGN PATENT DOCUMENTS

| | | |
|---|---|---|
| 195 45 736 | 6/1997 | (DE) . |
| 19-803 455 | 8/1999 | (DE) . |
| 233 9664 | 8/1977 | (FR) . |
| 54-054 101 | 4/1979 | (JP) . |
| 57-051 786 | 3/1982 | (JP) . |
| 57-051 787 | 3/1982 | (JP) . |
| 57-083 585 | 5/1982 | (JP) . |
| 57-090 092 | 6/1982 | (JP) . |
| 58-091 788 | 5/1983 | (JP) . |
| 59-051 978 | 3/1984 | (JP) . |
| 59-053 589 | 3/1984 | (JP) . |
| 59-071 388 | 4/1984 | (JP) . |
| 59-108 083 | 6/1984 | (JP) . |
| 59-145 281 | 8/1984 | (JP) . |
| 61-106 690 | 5/1986 | (JP) . |
| 62-011 794 | 1/1987 | (JP) . |
| 01-103 694 | 4/1989 | (JP) . |
| 01-249 886 | 10/1989 | (JP) . |
| 08-127 778 | 5/1996 | (JP) . |

* cited by examiner

*Primary Examiner*—Gregory Wilson
(74) *Attorney, Agent, or Firm*—Luedeka, Neely & Graham PC

(57) ABSTRACT

The invention provides a coke oven charging machine including a mobile frame and a coke oven feed device on the mobile frame. The coke oven feed device includes a movable, elongate charging plate having a first end and a second end, retractable side-walls adjacent the charging plate, first and second end walls adjacent the first and second ends of the charging plate and a shuttle section adjacent the first end of the charging plate for spanning an area between the first end of the charging plate and an entrance to the oven. The shuttle section has opposed shuttle side walls and a shuttle end wall. A charging plate moving device is provided for moving the charging plate into and out of the oven. The charging machine apparatus provides a means for quickly charging coking ovens with a compacted coal charge so that lower quality coals may be used to make metallurgical coke.

17 Claims, 11 Drawing Sheets

METHOD AND APPARATUS FOR COAL COKING

FIELD OF THE INVENTION

The invention relates to a method and apparatus for making coke from coal and in particular to a method and apparatus for compacting and feeding coal to a non-recovery coking oven.

BACKGROUND

Coke is a solid carbon fuel and carbon source used to melt and reduce iron ore in the production of steel. During an iron-making process, iron ore, coke, heated air and limestone or other fluxes are fed into a blast furnace. The heated air causes combustion of the coke which provides heat and a source of carbon for reducing iron oxides to iron. Limestone or other fluxes may be added to react with and remove the acidic impurities, called slag, from the molten iron. The limestone-impurities float to the top of the molten iron and are skimmed off.

In one process, known as the "Thompson Coking Process," coke used for refining metal ores is produced by batch feeding pulverized coal to an oven which is sealed and heated to very high temperatures for 24 to 48 hours under closely controlled atmospheric conditions. Coking ovens have been used for many years to covert coal into metallurgical coke. During the coking process, finely crushed coal is heated under controlled temperature conditions to devolatilize the coal and form a fused mass having a predetermined porosity and strength. Because the production of coke is a batch process, multiple coke ovens are operated simultaneously, hereinafter referred to as a "coke oven battery".

At the end of the coking cycle, the finished coke is removed from the oven and quenched with water. The cooled coke may be screened and loaded onto rail cars or trucks for shipment or later use or moved directly to an iron melting furnace.

The melting and fusion process undergone by the coal particles during the heating process is the most important part of the coking process. The degree of melting and degree of assimilation of the coal particles into the molten mass determine the characteristics of the coke produced. In order to produce the strongest coke from a particular coal or coal blend, there is an optimum ratio of reactive to inert entities in the coal. The porosity and strength of the coke are important for the ore refining process and are determined by the coal source and/or method of coking.

Coal particles or a blend of coal particles are charged into hot ovens on a predetermined schedule, and the coal is heated for a predetermined period of time in the ovens in order to remove volatiles from the resulting coke. The coking process is highly dependent on the oven design, the type of coal and conversion temperature used. Ovens are adjusted during the coking process so that each charge of coal is coked out in approximately the same amount of time. Once the coal is coked out, the coke is removed from the oven and quenched with water to cool it below its ignition temperature. The quenching operation must also be carefully controlled so that the coke does not absorb too much moisture. Once it is quenched, the coke is screened and loaded into rail cars or trucks for shipment.

Because coal is fed into hot ovens, much of the coal feeding process is automated. In slot-type ovens, the coal is typically charged through slots or openings in the top of the ovens. Such ovens tend to be tall and narrow. More recently, non-recovery or heat recovery type coking ovens have been used to produce coke. Such ovens are described for example in U.S. Pat. Nos. 3,784,034 and 4,067,462 to Thompson. Conveyors are used to convey the coal particles into the ovens and to level the coal in the ovens.

As the source of coal suitable for forming metallurgical coal has decreased, attempts have been made to blend weak or non-coking coals with coking coals to provide a suitable coal charge for the ovens. One attempt is to use compacted coal. The coal may be compacted before or after it is in the oven. While coal conveyors are suitable for charging ovens with particulate coal which is then compacted in the oven, they are generally not suitable for charging ovens with pre-compacted coal. There is a need therefor, for a method and apparatus for charging coking ovens with pre-compacted coal. There is also a need for an apparatus for compacting coal in a short period of time in order to reduce labor and production costs for making metallurgical coke.

SUMMARY OF THE INVENTION

In accordance with the foregoing need, the invention provides an improved coke oven charging device and method for charging compacted coal to a coking oven, the coking oven having an exhaust-flue heated floor, substantially parallel vertical side-walls, a pusher door adjacent an oven entrance, a coke door adjacent an oven exit and an arched substantially closed roof. According to the method, a coke oven pusher and charging machine is moved adjacent the pusher door of the oven. The coke oven pusher and charging machine includes a movable, elongate charging plate having a first end and a second end, retractable side-walls adjacent the charging plate, a first end wall adjacent the second end of the charging plate, a charging plate moving device for moving the charging plate into and out of the oven and a movably separate coal guide section adjacent the first end of the charging plate for spanning an area between the first end of the charging plate and the oven entrance. The coal guide section includes a bottom wall, opposed fixed side walls attached to the bottom wall and opposed second and third end walls movable with respect to the bottom wall and fixed side walls.

Particulate coal is fed to the charging plate between the side walls and second end wall of the coal guide section and to the coal guide section between the second and third end walls to form first and second coal beds. The coal in the first coal bed is compacted between the retractable side walls and first and second end walls. The pusher door is removed from the coking oven entrance and the coke door is removed from the oven exit. Coke is pushed out of the coking oven into a hot car and the coke door is reattached to the oven exit.

A portion of the coal guide section is transported into the oven entrance in order to span a distance between the oven entrance and the charging plate. The second and third end walls are retracted from the bottom wall of the coal guide section in order to deposit uncompacted coal in at least a portion of the oven. The retractable side walls are retracted from the compacted coal on the charging plate. The charging plate containing compacted coal is moved into the oven over the coal guide section while pushing uncompacted coal ahead of the compacted coal so that the uncompacted coal forms a layer of substantially uncompacted coal between the heated oven floor and the charging plate. The second and third end walls are repositioned adjacent the charging plate and the charging plate is retracted from the oven while holding the compacted coal in the oven using the third end wall. Finally, the coal guide section is withdrawn from the oven entrance and the pusher door is reattached to the oven.

In another aspect the invention provides a coke oven charging machine including a mobile frame and a coke oven feed device on the mobile frame. The coke oven feed device includes a movable, elongate charging plate having a first end and a second end, retractable side-walls adjacent the charging plate, first and second end walls adjacent the first and second ends of the charging plate and a shuttle section adjacent the first end of the charging plate for spanning an area between the first end of the charging plate and an entrance to the oven. The shuttle section has opposed shuttle side walls and a shuttle end wall. A charging plate moving device is provided for moving the charging plate into and out of the oven.

In yet another aspect the invention a method for charging coal to a coking oven. The method includes the steps of providing a bed of compacted coal on a first charging plate and a bed of uncompacted coal on a second charging plate. The first charging plate is located outside the oven adjacent an oven entrance and the second charging plate is positioned between the first charging plate and the oven entrance and vertically below the first charging plate so that the first charging plate may be urged to pass over the second charging plate. A portion of the second charging plate is urged into the oven entrance to deposit uncompacted coal adjacent the oven entrance and partially in the oven. The first charging plate is advanced into the oven through the entrance and over the second charging plate to position compacted coal in the oven, whereby portions of the first charging plate and compacted coal contact portions of the uncompacted coal to urge uncompacted coal into the oven ahead of and beneath the first charging plate as the first charging plate is advanced into the oven. The first charging plate is then withdrawn from the oven through the oven entrance and the second charging plate is withdrawn from the oven entrance to yield a resulting coal bed within the oven comprising a compacted coal bed overlying uncompacted coal.

The method and apparatus described above provide unique advantages for coking operations including providing insulation between the hot oven floor and the charging plate of the oven charging apparatus so as to reduce warpage of the charging plate caused by heat. The charging plate is shielded by the loose coal layer and compacted coal from radiant heat from the floor and oven walls and does not contact the hot oven floor. Another advantage is that the coal is substantially evenly distributed in the oven without the need for leveling the coal in the oven. Any uneveness of the oven floor will also be compensated for by the loose coal layer. The loose coal layer also reducing sliding friction between the charging plate and oven floor thereby reducing wear on the charging plate and oven floor.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE PREFERRED EMBODIMENTS

Figure 1:
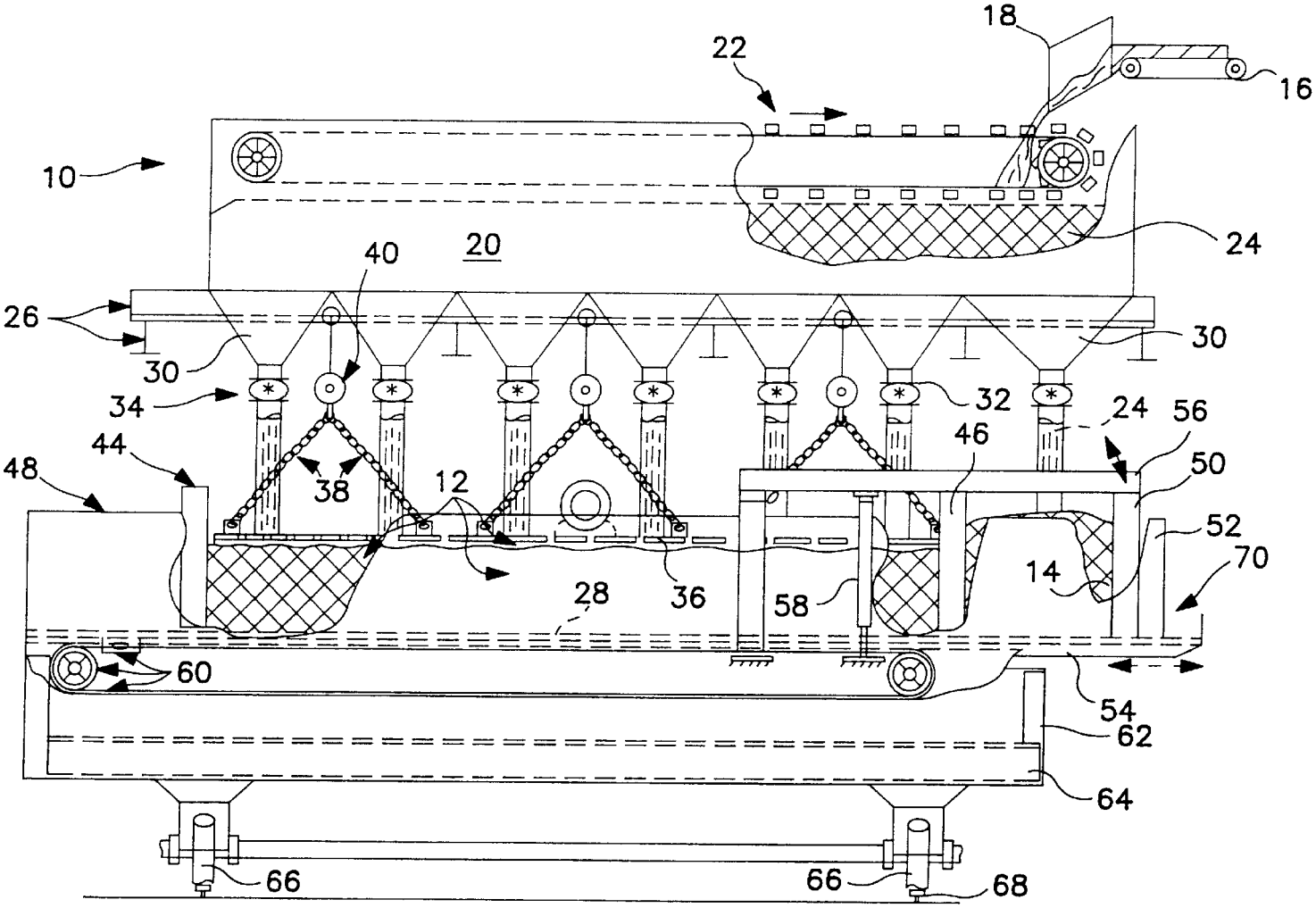
FIG. 1 is an overall plan view of a charging machine according to the invention.

With reference to FIG. 1, there is provided a charging machine 10 for a coke oven. The charging machine includes a compacted coal chamber 12 and an uncompacted coal chamber 14. Coal is provided to the compacted coal chamber and uncompacted coal chamber by means of a cross conveyor 16 for transferring coal from a coal supply to a charging chute 18 and into a coal charging chamber 20. The coal charging chamber 20 preferably includes a leveling device such as a chain flight leveling system 22 for distributing coal 24, preferably uncompacted coal into the coal charging chamber 20. The coal charging chamber 20 is supported above the compacted coal chamber 12 and uncompacted coal chamber 14 as by support beams 26.

Coal is deposited on a charging plate 28 and in the uncompacted coal chamber 14 by flow through two or more discharge chutes 30. The discharge chutes 30 are preferably pyramidal-shaped discharge chutes containing flanged exits 32. Discharge valves 34 which may be selected from rotary valves, slide gate valves, pinch valves and the like are preferably attached to the flanged exits 32 of each of the discharge chutes 30. It is particularly preferred to provide one or more discharge chutes 30 adjacent the uncompacted coal chamber 14 for depositing coal in chamber 14 separate from coal deposited on the charging plate 28.

A foraminous vibratory plate 36 is movably disposed between the charging chamber 20 and the charging plate 28. The foraminous plate has a thickness preferably ranging from about 2 to about 4 inches and preferably contains a plurality of holes having a diameter ranging from about 1 inch to about 4 inches. Foraminous plate 36 is preferably suspended so as to be moved toward and away from the charging plate 28 while maintaining a substantially parallel orientation with respect thereto. Accordingly, the foraminous plate 36 is preferably attached to support beams 26 as by chains 38 or other flexible support means and may be raised and lowered as by one or more pulleys 40 or other suitable adjusting structure. A vibrator 42 which may be selected from hydraulic or electro-mechanical rotatable eccentric weight or other suitable vibrating means is preferably attached to the foraminous plate 36.

The compacted coal chamber 12 of the charging machine 10 is defined by a substantially fixed end-wall 44, intermediate movable wall 46, movable side walls 48 and movable charging plate 28. The movable charging plate 28 preferably has a thickness ranging from about 2 to about 3 inches and is preferably made of cast steel. The intermediate movable wall 46 and movable front wall 50 along with stationary side walls 52 and the movable coal guide plate 54 define the uncompacted coal chamber 14. The intermediate movable wall 46 and movable front wall 50 are attached to a rectangular lifting frame 56 shown in more detail in FIGS. 2 and 3. An actuator 58 is attached to the coal guide plate 54 and is actuated to lift the lifting frame 56 during oven charging once the uncompacted coal chamber 14 is partially inserted into the oven.

The movable charging plate 28 is slidably positioned in the oven by moving the charging plate 28 over the coal guide plate 54 by means of a charging plate drive system 60. The charging plate drive system 60 is preferably a continuous chain drive assembly including a chain and chain drive unit, described in more detail below, attached to one end of the charging plate 28.

The entire coal filling and charging assembly described above is attached to a movable charging car 62 which includes a support frame 64 and wheels 66 defining the charging machine 10. The charging car 62 rides on rails 68 which are parallel to a battery of coke ovens and perpendicular to the coal charging direction into the oven. The charging car 62 may be a separately movable assembly which is coupled to a coke pusher assembly as described in U.S. Pat. No. 3,784,034 to Thompson, U.S. Pat. No. 3,912,091 to Thompson and U.S. Pat. No. 4,067,462 to Thompson incorporated by reference herein as if fully set forth.

Figure 2:
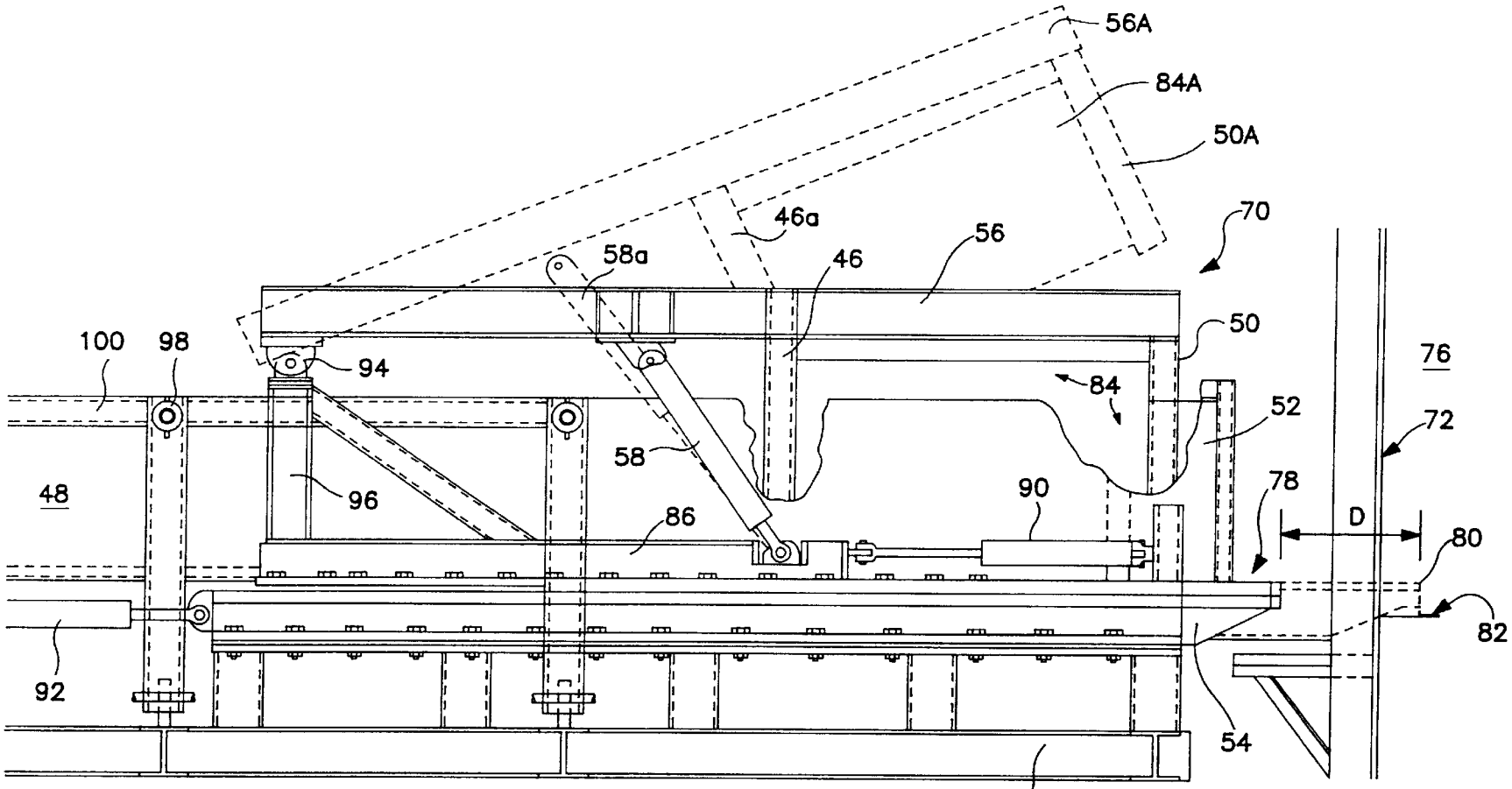
FIG. 2 is a top plan view of a portion of a charging machine according to the invention.

Details of the movable coal guide assembly 70 will now be described in detail with reference to FIGS. 2 and 3. The coal guide assembly 70 includes a movable coal guide plate 54 for supporting uncompacted coal 14 and for moving or bridging a gap between the movable charging car 62 (FIG. 1) and the coke oven entrance 72. The coal guide plate 54 is provided with a plate actuator 92 for moving the coal guide assembly 70 a distance D between the coal charging car 62 and the oven entrance 72. It is preferred that end 80 the coal guide plate 54 extend into a coke oven 76 a distance ranging from about 0.5 to about 1 foot or more so as to minimize the amount of uncompacted coal 14 which may be lost due to spillage at the oven entrance 72. Accordingly, the coal guide plate 54 preferably moves a distance ranging from about 15 to about 45 inches. As shown in FIG. 2, an upper surface 78 of the coal guide plate 54 is no more than about 6 to about 12 inches above oven floor surface 82.

The coal guide plate 54 is preferably a cast steel plate having a thickness ranging from about 2 to about 3 inches. The coal guide assembly 70 also includes stiffeners 84 which may include beams or plates fixedly attached to the intermediate wall 46 and front wall 50 to reduce flexing of the front wall 50. In a preferred embodiment, the stiffeners 84 are plates which form inner side walls of the uncompacted coal chamber 14. The outer side walls 52 and coal guide plate 54 are attached to one another and move as a unit partially into the oven 76. The intermediate wall 46 and movable front wall 50 are fixedly attached to lifting frame 56. The guide plate 54, side walls 52, stiffeners 84, intermediate wall 46 and front wall 50 define the uncompacted coal chamber 14 and move as a unit. Because of the heat generated by an open coke oven during charging, the plate 54 and front wall 50 may be optionally water-cooled such as by a water cooling circulating system. It is preferred that the front wall 50 be refractory-lined or otherwise insulated to reduce warping caused by excessive heat.

Figure 3:
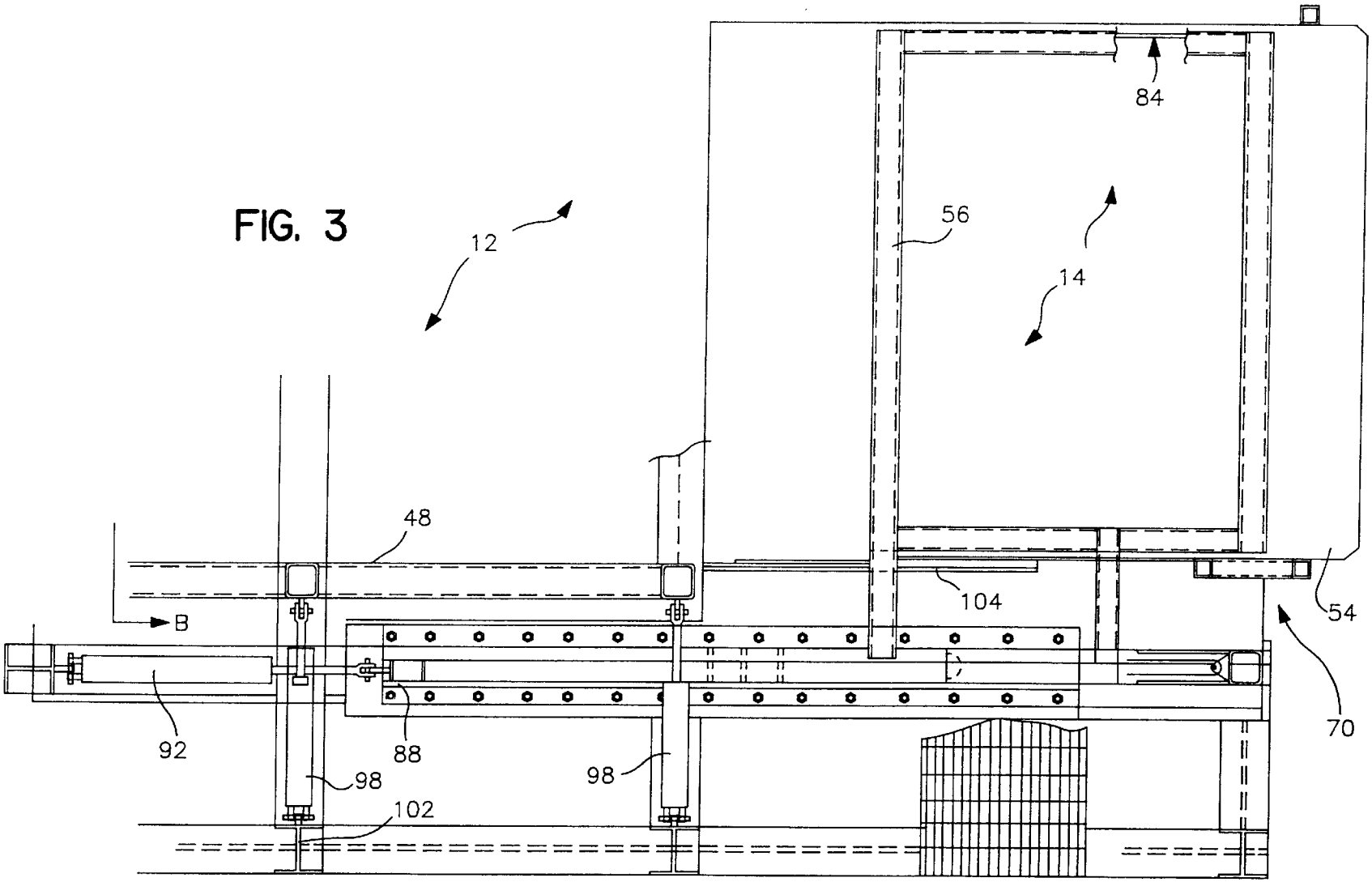
FIG. 3 is an elevational view of a portion of a charging machine according to the invention.

As seen in FIGS. 2 and 3, the lifting frame 56 is separately supported on the coal guide plate 54 on a slidable support frame 86. The slidable support frame 86 is slidably disposed on a slide surface 88 attached to the movable coal guide plate 54. A frame actuator 90 is attached to the slidable support frame 86 to move the support frame 86 along with the uncompacted coal chamber 14 toward the coking oven 76. A coal guide actuator 92 is attached to the coal guide slide plate 54 to translate the uncompacted coal chamber 14 partially into the oven 76. As shown in FIG. 2, actuator 58 is attached to the slidable support frame 86. After the coal guide plate 54 is partially in the oven, actuator 58 is activated to lift and rotate lifting frame 56 about a pivot assembly 94 so that walls 46*a* and 50*a* do not interfere with movement of compacted coal into the oven 76. The pivot assembly 94 is attached to a vertical pivot support beam 96 which is also attached to the guide plate 54.

Figure 4:
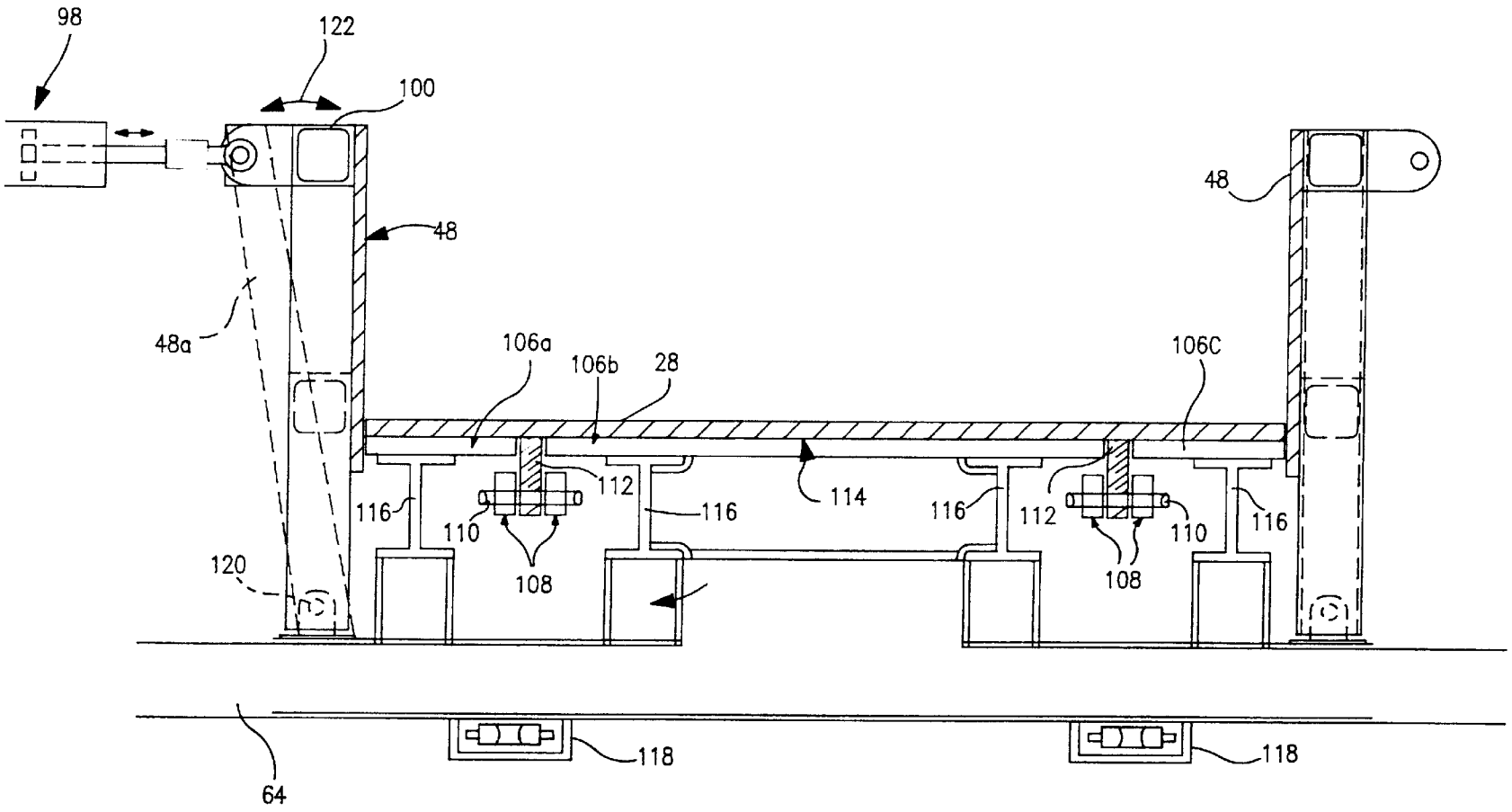
FIG. 4 is an end elevational view of a portion of a charging machine according to the invention.

After movement of the coal guide assembly 70 partially into the oven 76 and lifting of lifting frame 56 and intermediate wall 46 and front wall 50, the movable side walls 48 are retracted from the compacted coal 24 in compacted coal chamber 12 so as to reduce sliding friction while moving the compacted coal 24 into the oven 76. With reference to FIG. 4, the movable side walls 48 may be translated across the charging plate 28 transverse to the movement of compacted coal 24 into the oven or may be tilted away from the compacted coal 24 to provide a sufficient gap between the movable side walls 48 and the compacted coal 24. In a preferred embodiment, hydraulic actuators 98 are attached to an upper portion 100 of the side walls 48 and to a structural beam 102 attached to the charging car 62 for tiltable movement of the side walls 48 away from the compacted coal 24. The gap between the compacted coal and the side walls 48 should be sufficient to significantly reduce friction between the side walls 48 and the compacted coal 24. In this regard, the gap may range from 0.25 inches to about 3 inches or more adjacent the upper portion 100 of the side walls 48.

It is also preferred that a portion of the stationary side walls 52 of the coal guide assembly 70 at least partially overlap the side walls 48 for at least the distance the coal guide assembly is moved into the coke oven 76 as shown in FIG. 3. Overlapping a portion 104 of the side walls 48 reduces the amount of coal spilled from the coal guide assembly 70 during the charging operation.

With reference to FIG. 4 again, the charging plate 28 is preferably supported on slide plates. The slide plates are preferably provided in sections, preferably three sections 106*a*, 106*b* and 106*c* for support of the charging plate 28. The slide plates 106*a–c* preferably having a thickness ranging from about 2 to about 4 inches and have a relatively smooth finish. Friction reducing coatings may also be applied to the surface of slide plates 106*a–c* between the slide plates 106*a–c* and charging plate 28 to reduce sliding friction. A suitable friction reducing material includes graphite, oil grease and the like. Support beams 116 are attached to the charging car 62 for supporting the slide plates 106*a–c*.

The charging plate drive system 60 (FIG. 1) includes a chain drive 108, a drive pin 110 and a drive member 112 attached to an underside 114 of charging plate 28. The drive pin 110 is disposed in an aperture in drive member 112 and is attached to the drive chain 108 for translational movement of the charging plate 28 into and out of the oven. A chain return guide 118 is provide on the charging car 62 to guide the chain drive 108 during translational movement of the charging plate 28.

As shown in detail in FIG. 4, movable side walls 48 are pivotably connected to a pivot pin 120 on the support frame 64 of the charging car 62. Upon actuation of hydraulic actuator 98, movable walls 48 are tilted away from the compacted coal on charging plate 28 as shown by arrow 122 to a position indicated by walls 48*a*. After the compacted coal has been moved into the oven, actuators 98 are activated to return movable walls 48 to a substantially vertical orientation so that the walls are substantially perpendicular to a plane defined by charging plate 28.

FIGS. 5–11 provide a schematic representation of a preferred charging sequence for a coke oven using the apparatus of the invention. It will be understood that the sequence of steps may be varied. According to the charging sequence, a charging machine 10 (FIG. 1) is moved adjacent an oven to be charged. The compacted and uncompacted coal chambers 12 and 14 of the charging machine 10 are filled with coal from a coal charging chamber 20 as described above. Coal is supplied to the coal charging chamber 20 from a cross conveyor 16 and charging chute 18 as described above. The coal in the charging chamber is leveled by chain flight leveling system 22 prior to charging the compacted coal chamber 12 and the uncompacted coal chamber 14. For a coke oven having a width of about 12 feet and a length of about 45 feet and charged to a coal depth of from about 40 to about 50 inches, the coal charging chamber 20 is sized to preferably hold an amount of coal ranging from about 50 to about 80 tons of coal.

Uncompacted coal 24 from the charging chamber 20 is provided to uncompacted coal chamber 14 by opening discharge valve 34 on discharge chute 30 directly above the uncompacted coal chamber 14. The uncompacted coal chamber 14 is sized to hold an amount of uncompacted coal sufficient to provide a layer of uncompacted coal on the oven floor between the charging plate 28 and the oven floor as described in more detail below. The uncompacted coal chamber preferably holds from about 5 to about 20 wt. % of the total coal, preferably from about 5 to about 10 tons of uncompacted coal for the size coking oven described above. Ovens with a width less than about 12 feet and a length less than about 45 feet may require less uncompacted coal to provide the uncompacted coal layer. Likewise, a larger oven requires more coal to provide the uncompacted coal layer.

Once the coal is sufficiently leveled in coal chamber 20, valves 34 are opened on chutes 30 to dispense coal to the compacted and uncompacted coal chambers 12 and 14. As set forth above, the coal provided to compacted coal chamber 12 is preferably provided by sifting the coal from chutes 30 through foraminous vibratory plate 36. During the coal dispensing operation, the foraminous plate 36 is suspended by chains 38 above the charging plate 28 of the compacted coal chamber and a low amplitude, high frequency vibratory energy is applied to the plate 36 by means of vibrator 42. The vibratory energy provided by vibrator 42 preferably has an amplitude of less than about 0.5 inches and a frequency of about 1800/minute, for example. The motion of the plate 36 during the coal dispensing step is effective to enable the coal to form a substantially even level of coal on charging plate 28, both longitudinally and transversely.

Figure 5:
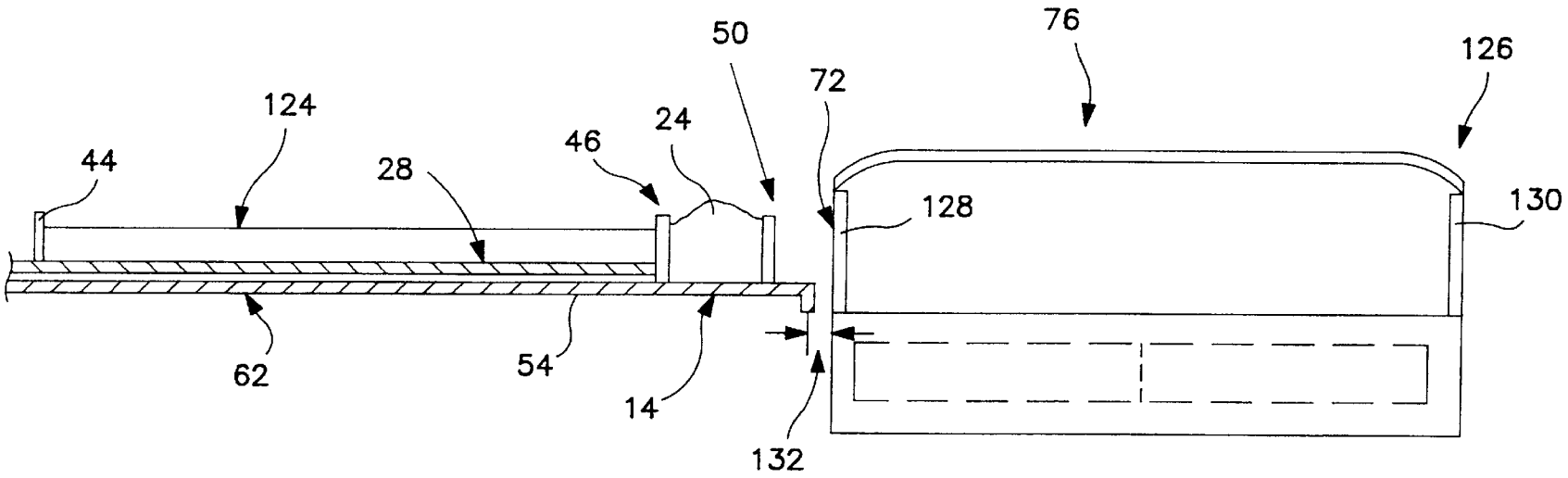
FIGS. 5–11 are schematic representations of a process for charging a coke oven using a charging machine according to the invention.

Referring to FIG. 5, coal is supplied to the charging plate 28 between fixed wall 44 and intermediate movable wall 46 to provide a compacted coal charge 124. Uncompacted coal 24 is disposed in uncompacted coal chamber 14 between intermediate movable wall 46 and movable front wall 50.

Once the compacted and uncompacted coal chambers 12 and 14 are fully loaded with coal, the foraminous plate 36 is lowered onto the uncompacted coal in chamber 12. Vibratory forces are applied to the plate as set forth above and the entire weight of the plate 36 on the coal causes the bulk density of the coal in chamber 12 to increase from about 40 to about 50 pounds per cubic foot to from about 60 to about 80 pounds per cubic foot. Compaction of the coal in chamber 12 may be accomplished in a single compaction step or in multiple compaction steps as the coal is loaded into chamber 12. Once the coal in chamber 12 is compacted, foraminous plate 36 is raised by means of chains 38 to a position above the compacted coal which does not interfere with movement of the compacted coal into the oven. It is preferred that the coal be compacted in less than about 5 minutes, preferably in from about 1 to about 3 minutes after depositing coal in compaction chamber 12.

Prior to oven charging, the charging machine 10 containing the compacted and uncompacted coal 124 and 24 is positioned adjacent an entrance 72 of a coking oven 76, which is preferably a non-recovery coking oven. Both the entrance and exit 72 and 126 of the coking oven preferably contain removable oven doors 128 and 130. Since coking ovens are in substantially continuous operation once initially started, previously finished coke must be removed from the oven 76 prior to charging the oven with compacted coal 124. Coke is removed from the oven 76 through the exit 126 using a coke pusher as described above inserted through oven entrance 72 after removing oven entrance door 128 to the position indicated in FIG. 6.

Figure 6:
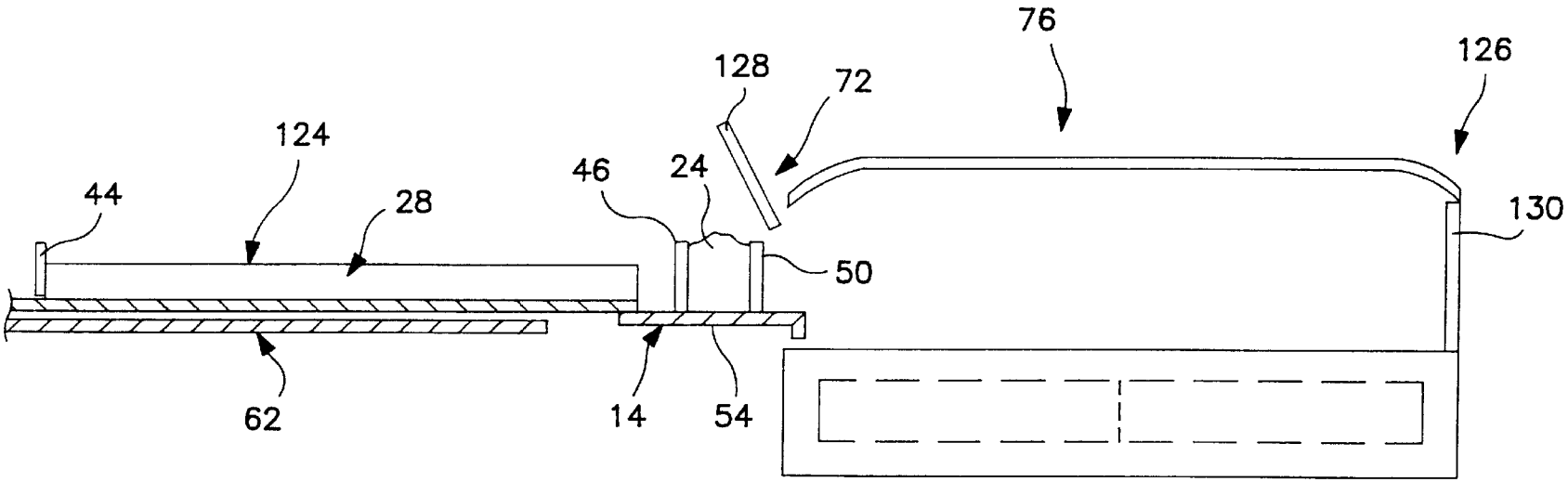

Regardless of how and when the finished coke is removed from the oven 76, once the charging car 62 is provided with coal and the coal compacted, the uncompacted coal chamber 14 is moved part way into the oven entrance 72. At this point, the movable coal guide plate 54 (FIG. 1) of the uncompacted coal chamber 14 spans the gap 132 between the charging car 62 and the oven 76 (FIGS. 5 and 6). Intermediate wall 46 and movable front wall 50 move along with the coal guide plate 54 toward the oven entrance 72 while the compacted coal 124 remains stationary.

Figure 7:
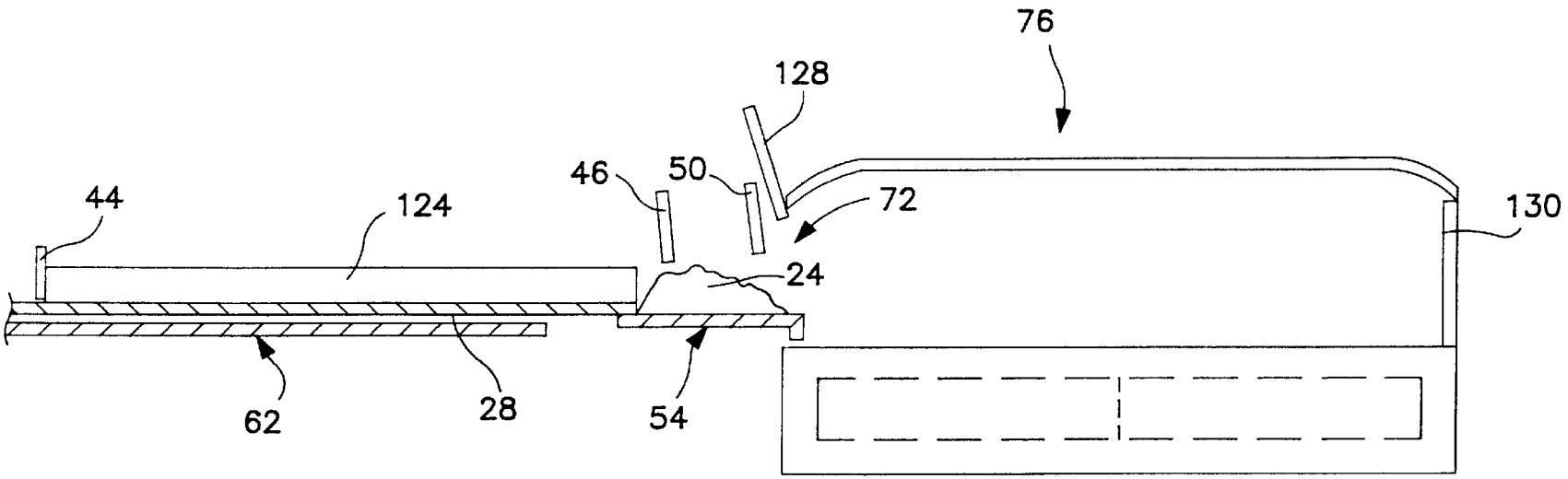

In the next step of the process, the intermediate wall 46 and front wall 50 are moved upwardly away from the coal guide plate 54. At this point, the uncompacted coal 24 spreads out into the oven entrance 72 and against the compacted coal 124 as shown in FIG. 7.

Figure 8:
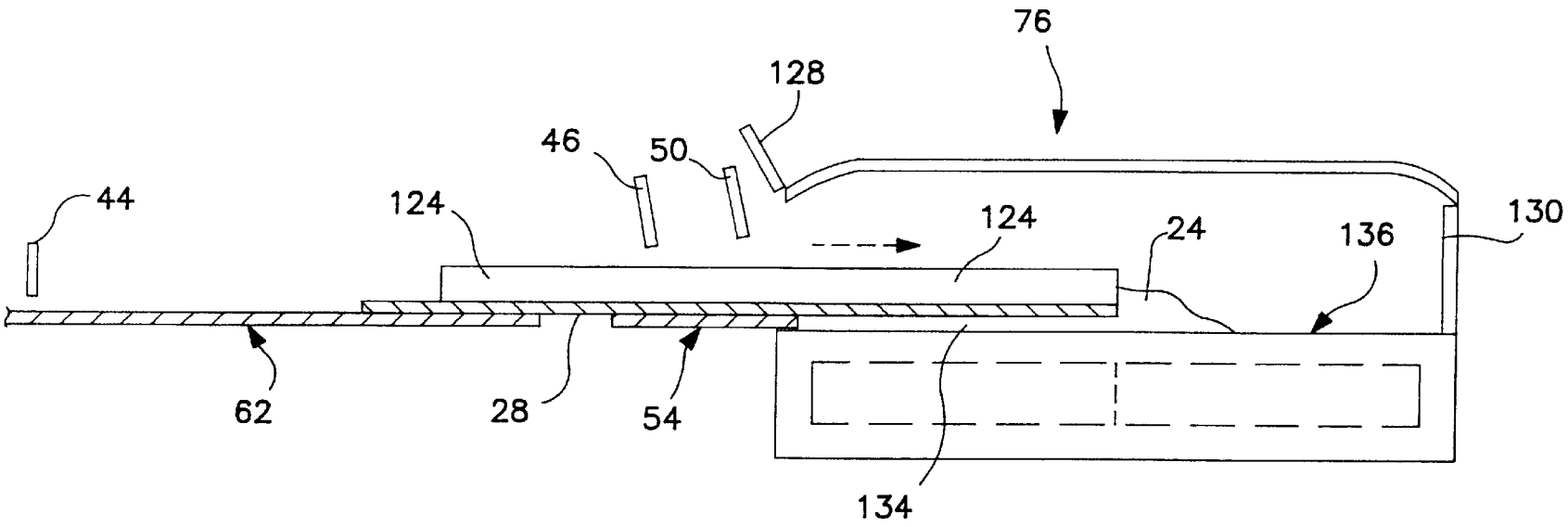
Figure 9:
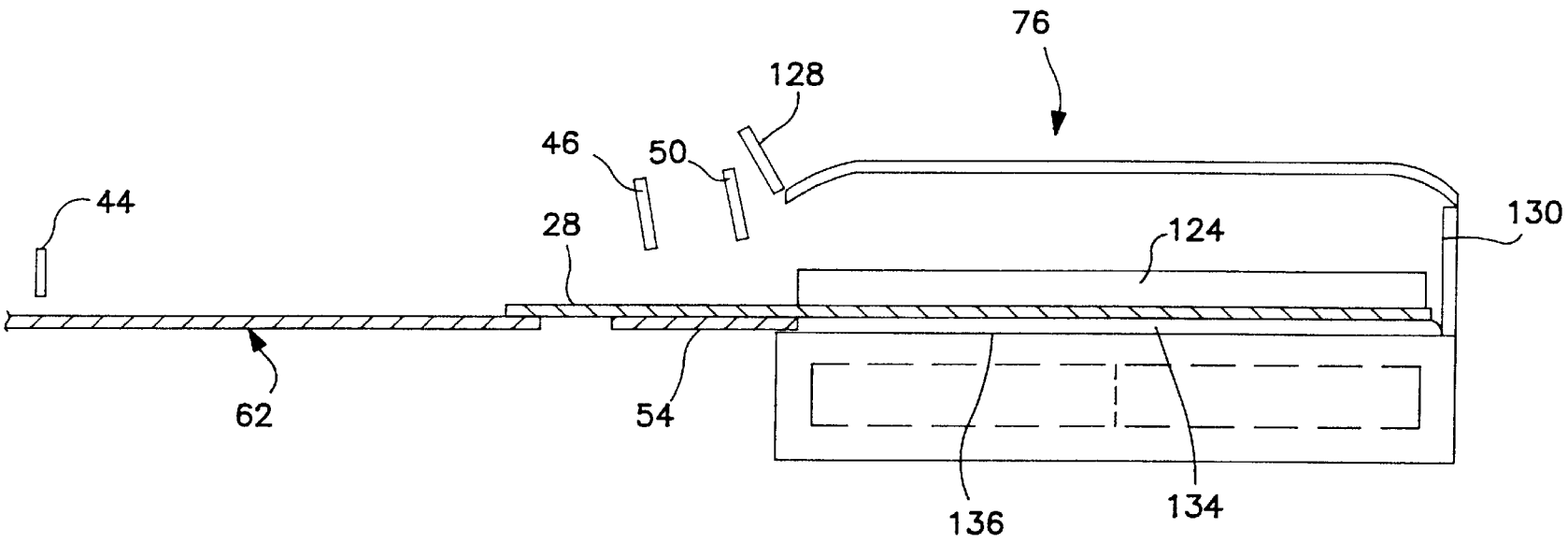

As shown in FIG. 8, the charging plate 28 is then moved into the oven 76 by activation of a drive motor attached to drive chains 108. As the charging plate 28 advances, uncompacted coal 24 is pushed forward of the compacted coal 124 so that a portion of the uncompacted coal 24 forms a layer 134 between the charging plate 28 and the oven floor 136 as the charging plate moves into the oven 76. The uncompacted coal layer 134 is preferably sufficient to insulate the charging plate 28 from the radiant heat of the oven floor 136 and provides a relatively smooth, level surface for movement of the charging plate 28 into and out of oven 76. As shown in FIG. 9, the charging plate 28 is moved into the oven 76 until the compacted coal 124 is completely in the oven and the uncompacted coal forms a layer 134 between charging plate 28 and the oven floor 136. The weight of the compacted coal 124 and charging plate 28 is sufficient to compress the uncompacted coal in layer 134 to increase its density above that of uncompacted coal 24.

Figure 10:
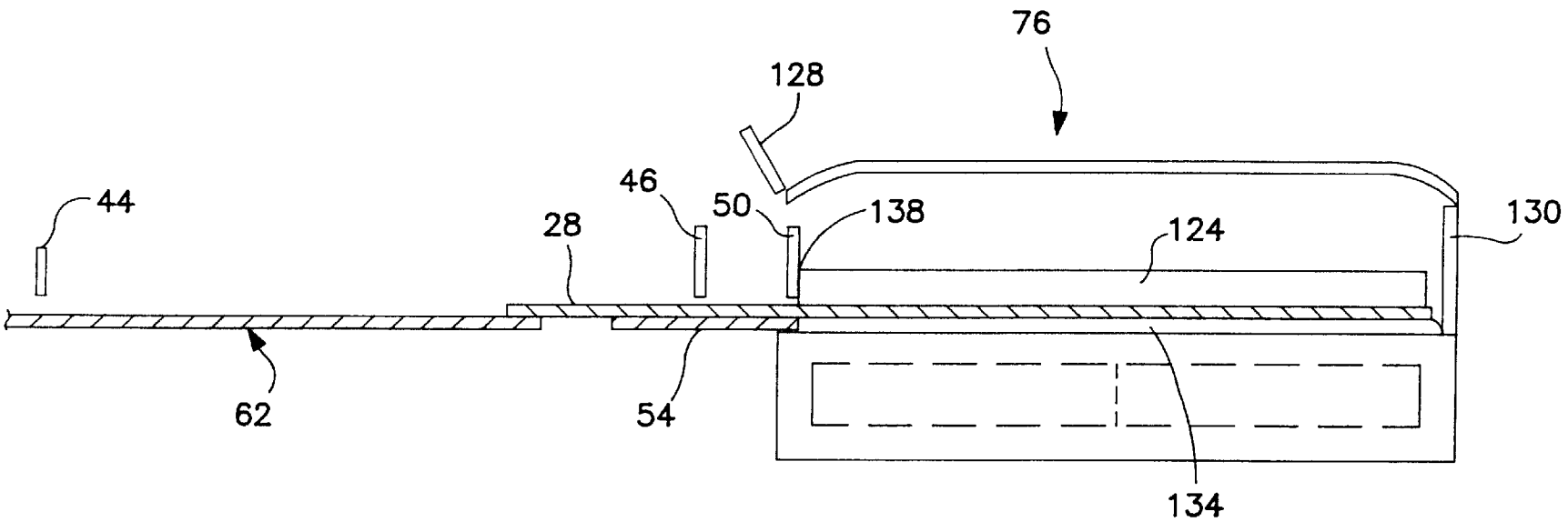
Figure 11:
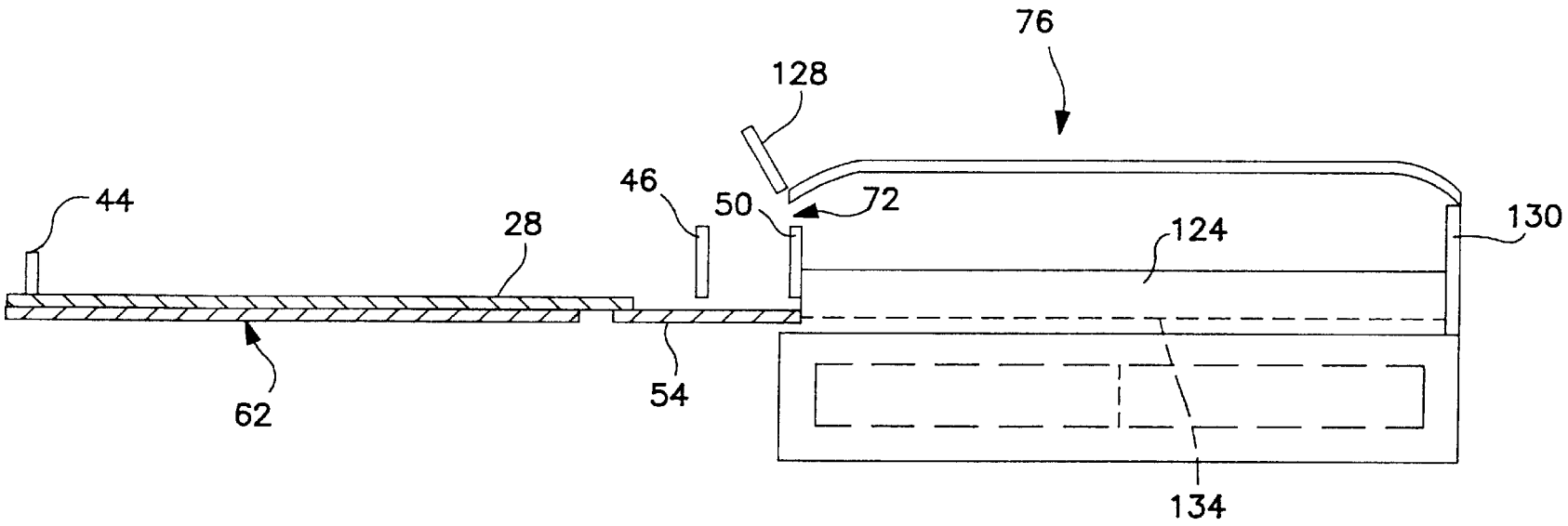

Once the oven 76 has been charged with compacted coal, intermediate wall 46 and front wall 50 are lowered to a position adjacent the charging plate 28 so that front wall 50 is adjacent one end 138 of the compacted coal 124 (FIG. 10). Front plate 50 is positioned or designed to be moved adjacent end 138 of the compacted coal 124 to hold the compacted coal in the oven 76 while withdrawing the charging plate 28 from the oven 76. As shown in FIG. 11, the charging plate 28 may be completely withdrawn from the oven 76 to its original position as shown in FIG. 5, while the compacted coal 124 and uncompacted coal layer 134 remain in the oven 76. As seen in FIG. 11, the intermediate wall 46 and front wall 50 are only lowered part way toward coal guide plate 54 so that the charging plate 28 may move easily between the coal guide plate 54 and walls 46 and 50.

In the final step of the operation, the uncompacted coal chamber 14 is moved away from the oven entrance 72 to its original position and the oven entrance door 128 is lowered and reattached to the oven entrance 72. At this point, the charging car 62 may be repositioned adjacent the next coke oven to be charged and the process of loading the charge car, compacting the coal and charging the oven is repeated.

In the foregoing description, the entire apparatus with the exception of conveyor belts, electrical components and the like may be made of cast or forged steel. Accordingly, robust construction of the apparatus is possible and provides a relatively long lasting apparatus which is suitable for the coke oven environment.

The apparatus and methods described above enable use of less costly coal for metallurgical coke production thereby reducing the overall cost of the coke. Depending on the particular coal source and the level of compaction achieved, a compacted coal charge made according to the invention may include up to about 80 wt. % non-coking coal. The amount of coke produced by the apparatus of the invention may also be increased from 35 to 42 tons up to about 50 to about 60 tons as a result of the compaction process. More consistent coal charge physical parameters such as coal charge height, width and depth are also a benefit of the apparatus and methods according to the invention.

Having described various aspects and embodiments of the invention and several advantages thereof, it will be recognized by those of ordinary skills that the invention is susceptible to various modifications, substitutions and revisions within the spirit and scope of the appended claims.

What is Claimed is:

1. A method for charging a coking oven with coal, the coking oven having an exhaust-flue heated floor, substantially parallel vertical side-walls, a pusher door adjacent an oven entrance, a coke door adjacent an oven exit and an arched substantially closed roof, the method comprising:

locating a coke oven pusher and charging machine adjacent the pusher door, the coke oven pusher and charging machine including a movable, elongate charging plate having a first end and a second end, retractable side-walls adjacent the charging plate, a first end wall adjacent the second end of the charging plate, a charging plate moving device for moving the charging plate into and out of the oven and a movably separate coal guide section adjacent the first end of the charging plate for spanning an area between the first end of the charging plate and the oven entrance, the coal guide section having a bottom wall, opposed fixed side walls attached to the bottom wall and opposed second and third end walls movable with respect to the bottom wall and fixed side walls;

feeding particulate coal to the charging plate between the side walls and second end wall of the coal guide section and to the coal guide section between the second and third end walls to form first and second coal beds;

compacting the coal in the first coal bed between the retractable side walls and first and second end walls;

removing the pusher door from the coking oven entrance;

removing the coke door from the oven exit;

pushing coke out of the coking oven into a hot car;

reattaching the coke door to the oven exit;

transporting a portion of the coal guide section into the oven entrance in order to span a distance between the oven entrance and the charging plate;

retracting the second and third end walls from the bottom wall of the coal guide section in order to deposit uncompacted coal in at least a portion of the oven;

retracting the retractable side walls from the compacted coal on the charging plate;

moving the charging plate containing compacted coal into the oven over the coal guide section while pushing uncompacted coal ahead of the compacted coal so that the uncompacted coal forms a layer of substantially uncompacted coal between the heated oven floor and the charging plate;

repositioning the second and third end walls adjacent the charging plate;

retracting the charging plate from the oven while holding the compacted coal in the oven using the third end wall;

withdrawing the coal guide section from the oven entrance and reattaching the pusher door on the oven.

2. The method of claim 1 wherein the coal is compacted using a vibratory compaction device.

3. The method of claim 1 wherein the coal is compacted to a bulk density ranging from about 60 to about 75 pounds per cubic foot.

4. The method of claim 1 wherein the retractable side walls are retracted by tilting the side walls away from the compacted coal.

5. The method of claim 1 wherein the uncompacted coal in the coal guide section is deposited in the coking oven by lifting the second and third end walls relative to the bottom wall.

6. A coke oven charging machine comprising a mobile frame including a coke oven feed device, the coke oven feed device including a movable, elongate charging plate having a first end and a second end, retractable side-walls adjacent the charging plate, a first end wall adjacent the second end of the charging plate, a charging plate moving device for moving the charging plate into and out of the oven and a movably separate coal guide section adjacent the first end of the charging plate for spanning an area between the first end of the charging plate and an entrance to the oven, the coal guide section having a bottom wall, opposed fixed side walls attached to the bottom wall and opposed second and third end walls movable with respect to the bottom wall and fixed side walls.

7. The coke oven charging machine of claim 6 further comprising a vibratory plate for compacting at least a portion of the coal on the charging plate.

8. The coke oven charging machine of claim 6 wherein the vibratory plate comprises a foraminous plate for distributing coal to be compacted onto the charging plate.

9. The coke oven charging machine of claim 6 wherein the retractable side walls comprise tiltable side walls.

10. The coke oven charging machine of claim 6 wherein the charging plate is a fluid cooled charging plate.

11. The coke oven charging machine of claim 6 further comprising a coal charging chamber and coal distribution device for depositing coal in the coal charging chamber.

12. The coke oven charging machine of claim 11 wherein the coal charging chamber further comprises at least two pyramidal-shaped discharge chutes for depositing coal from the charging chamber onto a vibrating foraminous plate for distributing coal to be compacted on the charging plate.

13. The coke oven charging machine of claim 12 wherein the vibrating plate is movably attached between the charging chamber and the charging plate.

14. The coke oven charging machine of claim 11 further comprising at least one pyramidal-shaped discharge chute for depositing uncompacted coal in the coal guide section thereof.

15. A method for charging coal to a coking oven, the method comprising the steps of:

providing a bed of compacted coal on a first charging plate and a bed of uncompacted coal on a second charging plate, the first charging plate being located outside the oven adjacent an oven entrance and the second charging plate being positioned between the first charging plate and the oven entrance and vertically below the first charging plate so that the first charging plate may be urged to pass over the second charging plate;

urging a portion of the second charging plate into the oven entrance to deposit uncompacted coal adjacent the oven entrance and partially in the oven;

advancing the first charging plate into the oven through the entrance and over the second charging plate to position compacted coal in the oven, whereby portions of the first charging plate and compacted coal contact portions of the uncompacted coal to urge uncompacted coal into the oven ahead of and beneath the first charging plate as the first charging plate is advanced into the oven; and withdrawing the first charging plate from the oven through the oven entrance and withdrawing the second charging plate from the oven entrance to yield a resulting coal bed within the oven comprising a compacted coal bed overlying uncompacted coal end walls to hold the compacted coal in the oven, withdrawing the movable charging plate and coal guide section from the oven and closing the oven charging door.

16. The method of claim 15 wherein the coal is compacted using a vibratory compaction device.

17. The method of claim 15 wherein the coal is compacted to a bulk density ranging from about 60 to about 75 pounds per cubic foot.

* * * * *